US006374717B1

(12) United States Patent
Schippers

(10) Patent No.: US 6,374,717 B1
(45) Date of Patent: Apr. 23, 2002

(54) DEVICE FOR PROVOKING AN AVALANCHE

(75) Inventor: Jacob Schippers, Le Touvet (FR)

(73) Assignee: Technologie Alpine de Securite T.A.S. S.A., Le Touvet (FR)

( * ) Notice: Subject to any disclaimer, the term of this patent is extended or adjusted under 35 U.S.C. 154(b) by 0 days.

(21) Appl. No.: 09/446,240

(22) PCT Filed: Jun. 22, 1998

(86) PCT No.: PCT/IB98/00972

§ 371 Date: Dec. 17, 1999

§ 102(e) Date: Dec. 17, 1999

(87) PCT Pub. No.: WO99/00638

PCT Pub. Date: Jan. 7, 1999

(30) Foreign Application Priority Data

Jun. 26, 1997 (FR) ..... 97 08246

(51) Int. Cl.[7] ..... F41F 5/00

(52) U.S. Cl. ..... 89/7; 89/1.1; 102/301; 102/302

(58) Field of Search ..... 89/7; 102/301, 102/302

(56) References Cited

U.S. PATENT DOCUMENTS 5,107,765 A * 4/1992 Schippers ..... 102/302

* cited by examiner

*Primary Examiner*—Michael J. Carone
*Assistant Examiner*—M Thomson
(74) *Attorney, Agent, or Firm*—Davis & Bujold, P.L.L.C.

(57) ABSTRACT

The invention concerns a device (10) for provoking an avalanche comprising a gas gun (12) the end of which is fixed to a seat (13) solidly anchored to the mountain and the downstream end of which is born by at least one leg (14) such that the mouth of the gun is arranged above the snow cover. The gun (1q2) upstream end is fixed to the seat (13) by an articulation (17), and the downstream end is ballasted, the leg (14) being mounted freely on a base (15) made integral with the ground. The leg (14) is hollow and contains ballast consisting of chippings or concrete. The gun (12) is further provided with ignition mechanisms (54) arranged upstream in its proximity and ensures the ignition of the detonating gas mixture.

13 Claims, 4 Drawing Sheets

DEVICE FOR PROVOKING AN AVALANCHE

FIELD OF THE INVENTION

The present invention concerns a device for provoking an avalanche consisting of a gas gun with its upstream end attached to a seating anchored solidly to the mountain and with its downstream end supported by at least one leg such that the mouth of the gun is located above the snow cover.

BACKGROUND OF THE INVENTION

Devices for provoking avalanches are known in the art, consisting of a gas gun affixed to the side of a mountain with its base solidly anchored in a seating consisting of a concrete block and with its mouth located above the snow cover, as described in U.S. Pat. No. 5,107,765. These guns are designed to provoke avalanches in exposed areas, for example, above ski stations or inhabited areas. The devices are very effective in provoking avalanches in zones known as avalanche corridors, that is, areas consisting primarily of steeply sloped gorges where snow accumulates rapidly and may attain unstable critical masses. They have proven particularly effective on light snow that is not dense and has a high volume of air trapped inside the snow crystals. The movement triggered by detonation provokes a wave effect with strong initial compression, followed by a slower movement that breaks up the snow cover and raises the mass of snow enough to provoke an avalanche. For this reason, the mouth of the gun must be located above the snow cover.

These devices must be rigidly and very solidly anchored to the side of the mountain, specifically, by using a concrete base anchored to rock and forming the rear seating for the gun itself. To support the front portion, near the mouth of the gun, the device has one or more legs also solidly anchored to the mountain.

When the gun is shot, the force exerted on the front region reaches 80 or 160 tons, depending upon the model, and a very strong anchor is required to counteract the forces which tend to dislodge the legs.

Anchors such as these are very expensive and are only resistant if the soil holding them is stable and resistant. In shifting, unstable terrain that lacks resistance, the legs supporting the mouth of the gun tend to become dislodged and pulled out of place with each successive firing. Since the devices are generally installed in locations that are difficult to reach and even dangerous, repairs are expensive and complicated.

SUMMARY OF THE INVENTION

The present invention proposes overcoming these disadvantages by offering an effective solution to the problems described above, a solution which also lowers installation costs and significantly increases the longevity of the apparatus.

This goal is accomplished by the device wherein the upstream end of the gun is attached to the base with an articulation and in that the downstream end is ballasted, with the leg freely positioned in a seat attached to the ground.

According to a variation of the invention, the downstream end of the gun is ballasted with at least one type ballast near the mouth.

The ballast may consist of a container of granular material or concrete introduced through an opening in said container.

According to a second variation, the downstream end of the gun has at least one form of ballast inside the leg supporting it.

This leg is preferably hollow and filled with granular material or concrete.

In all embodiments, the leg is essentially vertical; it rests freely in a seating rigidly anchored to the side of the mountain and it is joined to the gun with an articulation having a horizontal axle.

Preferably the device has an ignition means near the upstream end of the gun.

The ignition means preferably consists of a sparkplug connected to an ignition system comprising a pressure controller with a dual state microbreaker, a condenser, an electric battery, and an igniter, the microbreaker providing communication between the condenser and the igniter when it is in the first state and providing communication between the condenser and the battery when in the second state.

The device may also include a safety wire connecting the seating and the leg.

The device preferably has a stop pin disposed vertically in the seat supporting the leg, said supporting seat being made of concrete and comprising a steel base covered by a rubber plate to cushion the impact of the leg.

BRIEF DESCRIPTION OF THE DRAWINGS

The present invention will be better understood with reference to the description of some preferred embodiments and to the attached drawings, provided by way of non-limiting examples, in which.

DESCRIPTION OF THE PREFERRED EMBODIMENTS

Figure 1:
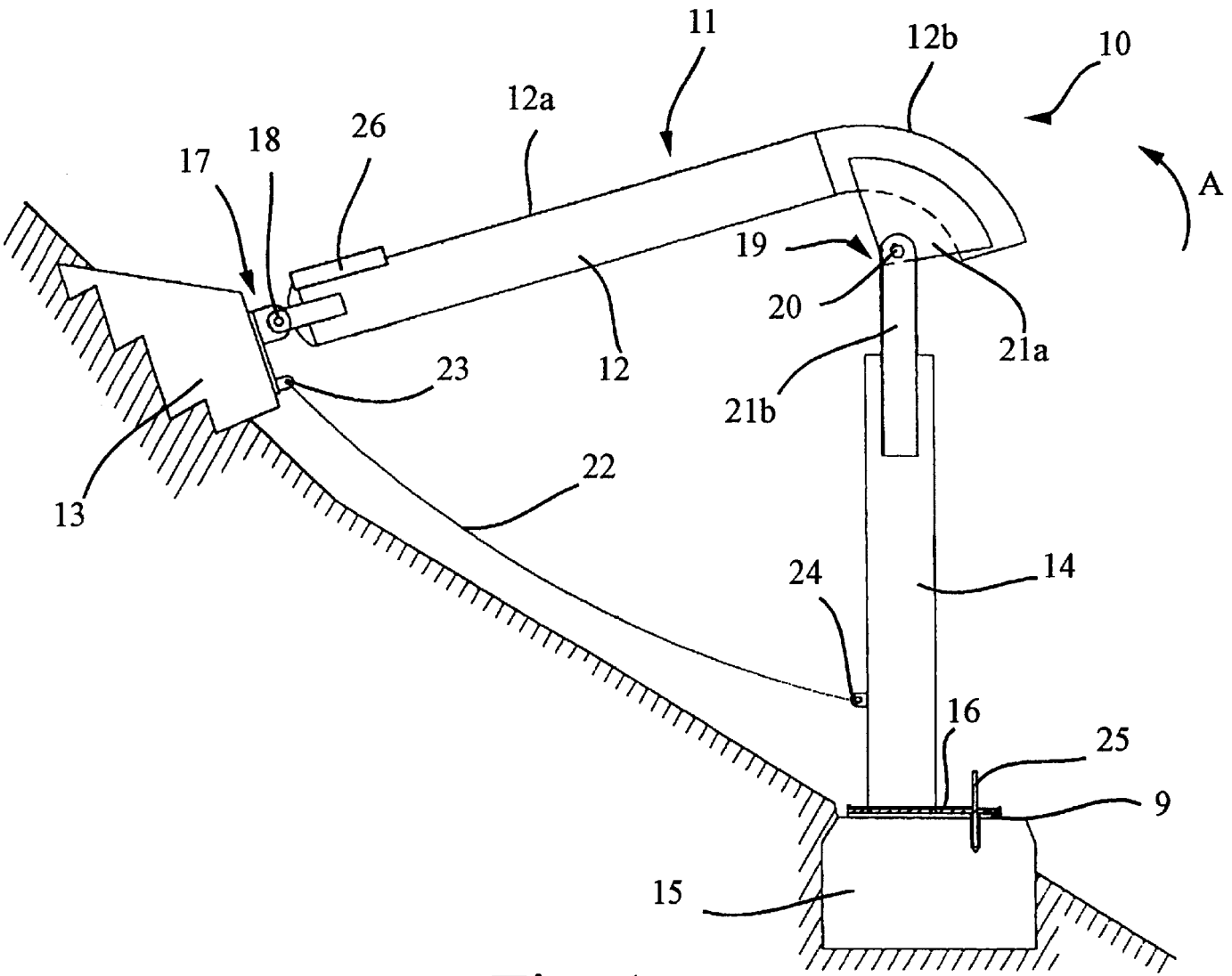
FIG. 1 is a view of a first embodiment of the device of the invention.

With reference to FIG. 1, the device 10 as shown essentially comprises a gas explosive device 11 consisting of a gun 12 attached by its upstream end to a seat 13, with its downstream end supported by a leg 14. Said leg 14 rests on a base 15 consisting of a block of concrete supporting a layer of steel 9 covered by a rubber plate 16. Seat 13 also consists of a block of concrete solidly anchored to the side of the mountain. Gun 12 is an elongated tubular element with a rectilinear portion 12*a* and a curved portion 12*b* forming the upstream end of the explosive device and defining the mouth.

The upstream end is attached to the seat by a seat articulation 17 with a horizontal axle allowing it to pivot in relation to the gun in the direction of arrow A.

Leg 14 consists of a generally cylindrical tubular element attached to the curved portion 12*b* of the gun by a leg articulation 19 with a horizontal axle 20. This articulation is composed of a first pair of fan-shaped elements 21*a*, parallel and on either side of the curved portion 12*b* of gun 12, and a second pair of clamp-type elements 21*b*, parallel and on either side of the upper portion of leg 14. These two pairs of elements are interconnected by means of horizontal axle 20.

There is ballast consisting of granular material or concrete inside the hollow tube forming leg 14. In actuality, the leg forms a support for the gun when at rest and it is suspended from the gun when the gun is fired and the downstream end of the gun lifts up due to the effects of the exploding gas. The purpose of the ballast is to limit the extent to which the gun pivots in the direction of arrow A and to ensure that the leg resumes its initial position.

Figure 4:
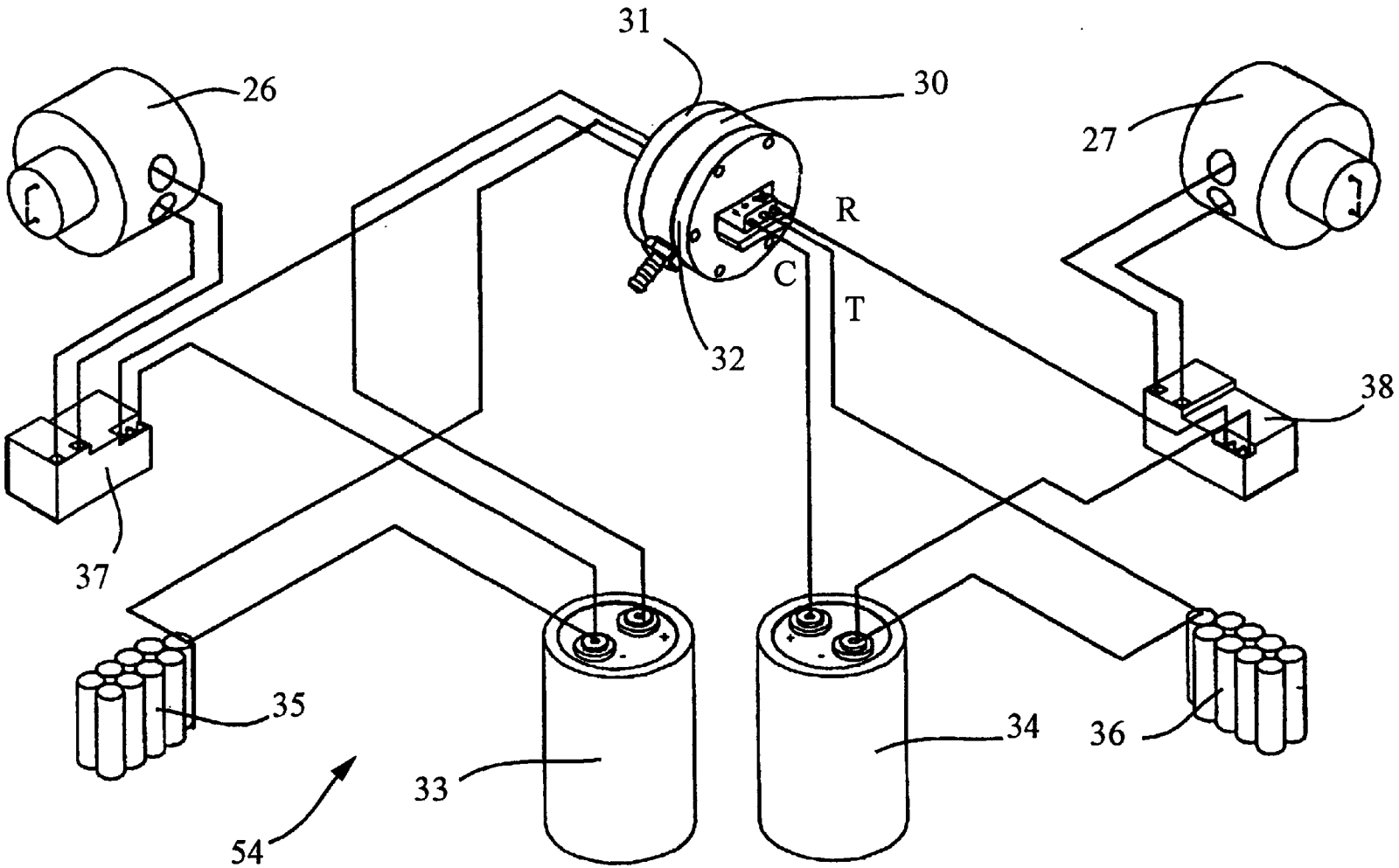
FIG. 4 is a detailed view of the ignition means provided on the device of the invention.

A safety wire 22 connects the bottom of leg 14 to seat 13. On one side, this wire is attached to a clamp 23 anchored to said seat and on the other side, to a clamp 24 attached to leg 14. A stop pin 25 is also affixed within base 15 through layer 9 and rubber plate 16 to prevent the possibility of the leg falling out of the seating after the gun is fired. Ignition means 54, which will be described in more detail with reference to FIG. 4, is attached in a floating manner to prevent problems with lightning and it surmounts the rear portion of gun 12.

Figure 2:
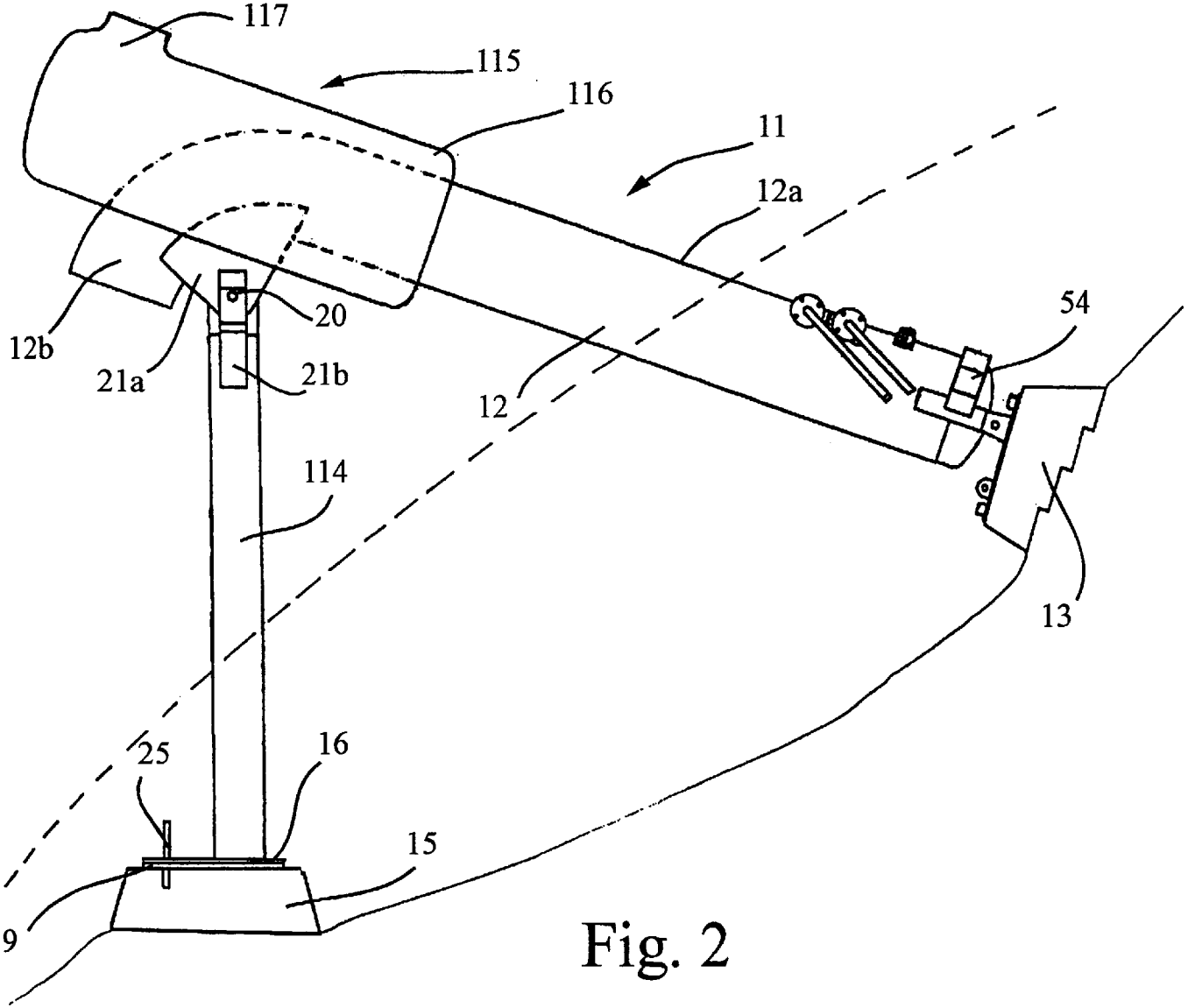
FIG. 2 shows a second embodiment of the device of the invention.

Another embodiment is illustrated in FIG. 2. The major difference between this variation and the preceding one is that leg 114 has no ballast, unlike leg 14 of FIG. 1, and that ballast 115 which accelerates the fall of the gun mouth after shooting and prevents the gun from lifting too high due to the force of the explosion, is attached near the mouth of the gun. The ballast is attached to the gun near its mouth. It preferably consists of a container 116 which can be filled with sufficient quantities of granular material or concrete.

The other components of the device that are similar to those already described, or to be described in more detail with reference to the following drawings, either bear or will bear like reference numerals.

Figure 3:
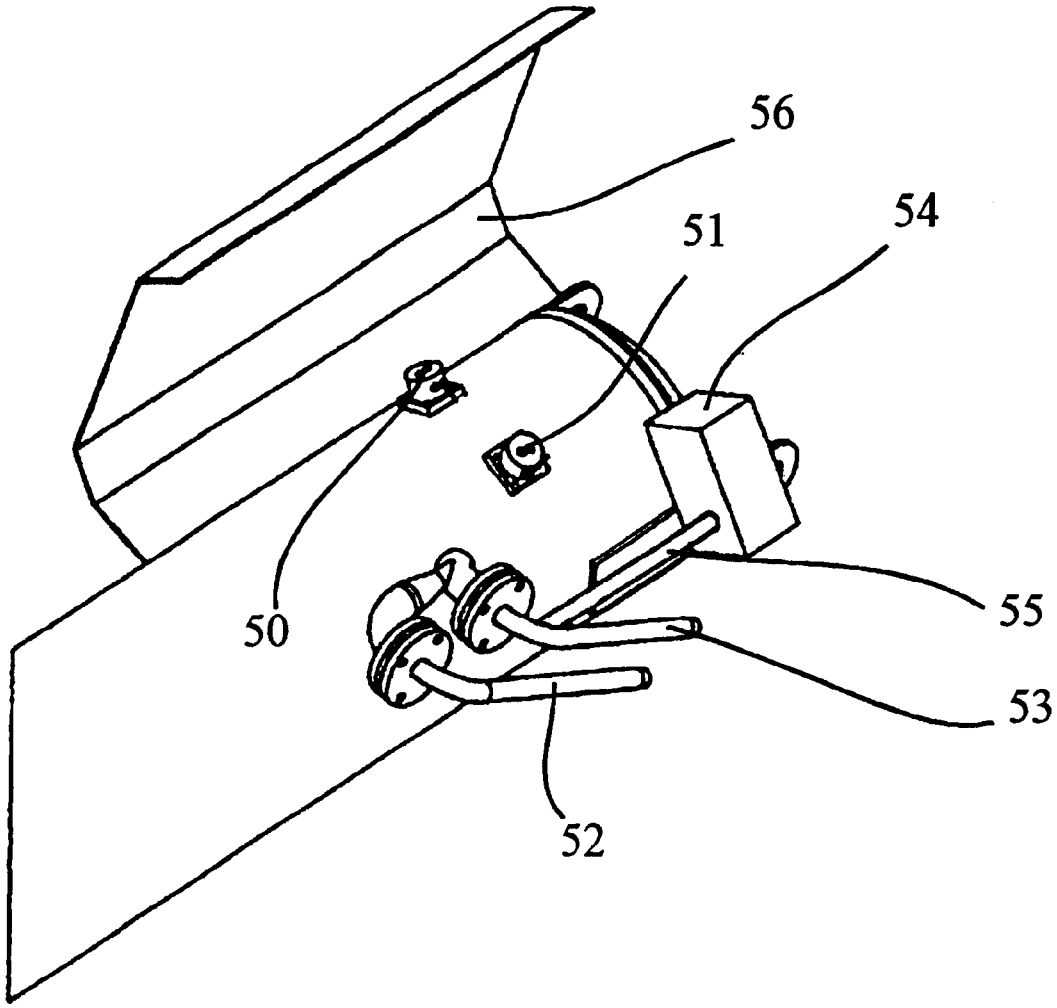
FIG. 3 is a detailed view of the device shown in FIG. 2.

FIG. 3 is a detailed view showing the upstream portion of the so-called gun 12 shown in FIG. 2, with the connecting terminals 50 and 51 of two spark plugs, the tips 52 and 53 of the combustible gas and oxygen inlets, and the ignition means 54. A flexible conduit 55 connects the ignition means to oxygen inlet 53. There is a folding protective cap 56 to cover the various elements.

With reference to FIG. 4, ignition means 54 comprises a pressure controller 30 controlling two dual state microbreakers 31 and 32 with three output terminals, viz., a terminal C called the common terminal, a terminal T called the working terminal, and a terminal R called the resting terminal. In the example shown wherein two spark plugs 26 and 27, respectively, are provided to light the detonating gas mixture, the ignition means further comprises two condensers 33 and 34, two batteries or storage cells 35 and 36, and two igniters 37 and 38. Pressure controller 30 is connected to the oxygen inlet by flexible conduit 55, or it may be attached directly to said conduit.

Microbreakers 31 and 32 are dual state switches. The first state, called the resting state, results when there is no gas circulating through the conduits and no pressure in pressure controller 30. Condensers 33 and 34 are thus in a closed circuit with igniters 37 and 38 and the battery/condenser circuits remaining open. The second state, called the working state, results when one of the gases circulating in the conduits creates slight pressure in pressure controller 30, provoking microbreakers 31 and 32 to change from the resting state to the working state. Since batteries 35 and 36 are connected in a closed circuit to condensers 33 and 34 and the condenser/igniter circuit is open, the condensers become charged while the gases are being injected.

Once the injection of gases into exploder 11 ceases, pressure on the membrane of pressure controller 30 becomes null and microbreakers 31 and 32 return to the resting state, closing the condenser/igniter circuit and opening the battery/condenser circuit. Each condenser then discharges completely into the corresponding igniter and causes a succession of sparks on the corresponding sparkplug for about 4 to 5 s. The microbreakers remain in this state until the next gas injection.

The fact that two spark plugs are provided is not limiting. A single spark plug would suffice for ignition. However, safety rules favor a duplicative ignition system as provided herein.

In practice, said first state results when oxygen circulates in the conduit and, by means of flexible conduit 55, creates pressure in pressure controller 30. At the moment the condensers discharge, they generate a series of sparks in the respective spark plugs which they supply.

What is claimed is:

1. A device for provoking an avalanche comprising:

a gas gun (12) having an upstream end and a downstream end having a mouth, the upstream end being attached to a seat (13) that is solidly anchorable in a mountain side and the downstream end being supported by at least one leg (14) so that the mouth of the gun is positionable above snow cover, the upstream end of the gun (12) being affixed to the seat (13) by a seat articulation (17), and the at least one leg (14) being freely movable relative to a base (15) anchorable in the mountain side, the at least one leg (14) extending generally vertically and connected to the downstream end of the gun (12) by a leg articulation (19) having a horizontal axle (20); and ignition means (54) located near the upstream end of the gun for discharging the device and provoking an avalanche;

wherein the downstream end of the gun is ballasted with at least one ballast (115) attached to the gun adjacent to the mouth.

2. The device according to claim 1, wherein the at least one ballast (115) comprises a container (116) which has an opening (117) therein, and the container (116) holds one of granular material and concrete.

3. The device according to claim 1, wherein the at least one ballast (115) is at least partially supported by the at least one leg (14) which supports the downstream end of the gun (12).

4. The device according to claim 3, wherein the at least one leg (14) is hollow and contains a ballast comprising one of granular material and concrete.

5. The device according to claim 1, wherein the ignition means comprises at least one spark plug (26) connected to an ignition system comprising a pressure controller (30) associated with a dual state microbreaker (31), a condenser (33), an electric battery (35) and an igniter (37), the dual state microbreaker, when in a first state, facilitates electrical communication between the condenser and the igniter and the dual state microbreaker, when in a second state, facilitates electrical communication between the condenser and the battery.

6. The device according to claim 1, further comprising a safety wire (22) which connects the seat (13) with the at least one leg (14).

7. The device according to claim 1, wherein the base (15) supporting the at least one leg (14) has a vertically arranged stop pin (25) to facilitate guiding vertical movement of the at least one leg (14) upon discharge of the device.

8. The device according to claim 1, wherein the base (15) supporting the at least one leg (14) is made of concrete and has a steel base (9) covered with a rubber plate (16) to cushion a return impact of the at least one leg (14) following discharge of the device.

9. A device for provoking an avalanche comprising:

a gas gun (12) having an upstream end and a downstream end with a mouth; the upstream end being attached to a seat (13) that is solidly anchorable in a mountain side and the downstream end being supported by at least one leg (14) such that the mouth of the gun is positionable above snow cover; the upstream end of the gun (12) being affixed to the seat (13) by a seat articulation (17); and a base (15) is anchorable in the mountain side and the at least one leg (14) is vertically movable relative to the base (15) upon discharge of the device;

wherein a safety wire (22) connects the seat (13) with the at least one leg (14).

10. The device according to claim 9, wherein the ignition means comprises at least one spark plug (26) connected to an ignition system comprising a pressure controller (30) associated with a dual state microbreaker (31), a condenser (33), an electric battery (35) and an igniter (37), the dual state microbreaker, when in a first state, facilitates electrical communication between the condenser and the igniter and the dual state microbreaker, when in a second state, facilitates electrical communication between the condenser and the battery.

11. A device for provoking an avalanche comprising:

a gas gun (12) having an upstream end and a downstream end with a mouth; the upstream end being attached to a seat (13) that is solidly anchorable in a mountain side and the downstream end being supported by at least one leg (14) such that the mouth of the gun is positionable above snow cover; the upstream end of the gun (12) being affixed to the seat (13) by a seat articulation (17); and a base (15) is anchorable in the mountain side and the at least one leg (14) is vertically movable relative to the base (15) upon discharge of the device;

wherein the base (15) which supports the at least one leg (14) has a vertically arranged stop pin (25) to facilitate guiding vertical movement of the at least one leg (14) upon discharge of the device.

12. The device according to claim 11, wherein the base (15) supporting the at least one leg (14) is made of concrete and has a base (9) covered with rubber (16) to cushion a return impact of the at least one leg (14) on the base following discharge of the device.

13. The device according to claim 11, wherein the ignition means comprises at least one spark plug (26) connected to an ignition system comprising a pressure controller (30) associated with a dual state microbreaker (31), a condenser (33), an electric battery (35) and an igniter (37), the dual state microbreaker, when in a first state, facilitates electrical communication between the condenser and the igniter and the dual state microbreaker, when in a second state, facilitates electrical communication between the condenser and the battery.

* * * * *